United States Patent [19]

Jung et al.

[11] Patent Number: 4,575,065

[45] Date of Patent: Mar. 11, 1986

[54] WEB LAYING MACHINE AND METHOD

[75] Inventors: Rolf Jung, Waiblingen; Winfried Buchmann, Hemmingen; Albert Buss, Münsingen, all of Fed. Rep. of Germany

[73] Assignee: Krauss u. Reichert GmbH & Co. KG, Spezialmaschinenfabrik, Fellbach, Fed. Rep. of Germany

[21] Appl. No.: 721,069

[22] Filed: Apr. 8, 1985

[30] Foreign Application Priority Data

Apr. 13, 1984 [DE] Fed. Rep. of Germany ..... 3413985

[51] Int. Cl.[4] ..... B65H 29/46

[52] U.S. Cl. ..... 270/31; 242/56 R

[58] Field of Search ..... 270/30–31; 242/56 R, 56 A, 56 B, 58

[56] References Cited

U.S. PATENT DOCUMENTS

| | | | |
|---|---|---|---|
| 2,980,421 | 4/1961 | Deichmann | 270/31 |
| 3,941,366 | 3/1976 | Feld | 270/31 |
| 4,477,065 | 10/1984 | Smith et al. | 270/31 |
| 4,505,466 | 3/1985 | Buss | 270/31 |
| 4,519,595 | 5/1985 | Adachi | 270/31 |
| 4,527,789 | 7/1985 | Nasu | 270/31 |

*Primary Examiner*—E. H. Eickholt

*Attorney, Agent, or Firm*—Spencer & Frank

[57] ABSTRACT

A web laying machine has a laying carriage driven back-and-forth over the laying table in a web laying direction. The laying carriage includes a chassis, an upper part mounted on the chassis and movable transversely to the laying direction relative to the chassis and rotatable about a vertical axis. A sled, carrying a support mechanism for a web supply reel is arranged on the upper part, and has a first position and a second position spaced from the first position in a direction parallel to the laying direction. The sled is movable from the one to the other position by rotating the upper part through an angle of 180° or by linearly displacing the sled relative to the upper part. A web guide mechanism extends transversely to the laying direction and is supported on the sled underneath the support mechanism for causing the web to hang from the sled at approximately the same location thereof independently from an unwinding direction of the supply reel and for causing a leading end of the web to be positioned in a web intake zone of a feed roll which is supported on the chassis and which is rotated as a function of the travelling speed of the carriage.

20 Claims, 19 Drawing Figures

WEB LAYING MACHINE AND METHOD

BACKGROUND OF THE INVENTION

This invention relates to a web laying machine of the known type which has a motor driven wheeled laying carriage travelling back and forth over a laying table. The laying carriage has a carriage chassis as well as an upper laying carriage portion which, by means of drives, is shiftable transversely to a laying direction with respect to the chassis and is rotatable about a vertical axis. On the upper laying carriage portion there is mounted a support mechanism for a web supply reel and a drive mechanism for unwinding the supply reel. The web laying machine further has a feed roll which is rotatably supported on the carriage chassis and which has an axis oriented parallel to that of the supply reel. The feed roll is driven as a function of the travelling speed of the laying carriage. On the carriage chassis there is further mounted a laying aggregate for deflecting and cutting the web.

By "web" there is meant a flexible sheet material which may be a fabric or other woven or nonwoven material and which, as stock material, has a predetermined width and generally an undetermined length.

Laying machines of the above-outlined type lay the web in individual superposed layers resulting in a web stack. In the simplest kind of web laying method no consideration has to be given to the laying direction and it is immaterial whether the same side of the web is always oriented towards the laying table. A particular type of web laying, however, is the pairwise laying of the web.

In a method of a pairwise web laying, the web, which has a first side and an opposite second side is so deposited on the laying table that in each instance on the first side of one layer there is positioned the first side of the following layer and on the second side of a layer the second side of the consecutive layer is placed. Stated differently, the web stack is built up in such a manner that in each instance the first sides and the second sides of the individual layers are in a face-to-face contacting relationship with one another. In case of the pairwise laying of the web, care has to be taken that the web has a "preferred direction" which means that the individual layers are always laid in the same direction and therefore, for example, a zigzag laying cannot be performed.

It follows from the above that a pairwise web laying is a very complex laying process because after the laying of each layer the web has to be turned over in such a manner that upon laying of the subsequent web layer in the same laying direction the web is laid with faces reversed. The turning over of the web has to be performed as rapidly as possible to save time and therefore it is an ever increasing desideratum that in a web laying machine this operation be performed substantially fully automatically. Further, also for purposes of time saving, it is generally required of web laying machines that the web taken off the supply reel be automatically threaded into the laying mechanism. In this connection, it has to be taken into consideration that the web reels may conceivably be wound in opposite directions so that the laying machine should be so designed for an automatic threading that a reverse winding direction of the supply reel does not pose any problems for the automatic threading.

German Offenlegungsschrift (published non-examined application) No. 2,922,930 discloses a web laying machine which is adapted for a pairwise laying and which performs automatic threading. The apparatus includes a laying carriage having a carriage chassis as well as an upper laying carriage portion which is mounted on the chassis and which is adapted, by means of drive arrangements, to execute shifting motions relative to the chassis and transversely to the laying direction. On the upper laying carriage portion there are mounted the web supply reel, the feed roll as well as the laying aggregate. To perform threading of the web, the supply reel is shiftable in the laying direction and may thus be positioned above the feed roll in such a manner that the web hanging from the feed roll extends on one side thereof. Subsequently, the supply reel is shifted in the laying direction such that the web lies on top of the feed roll and forms a freely hanging loop on the opposite side thereof. Thus, in the threaded condition the web hanging from the supply reel forms a loop, then extends over the feed roll and, from the feed roll side opposite the loop passes to the web laying aggregate.

In the pairwise laying of a web in the above-described prior art machine, the entire upper laying carriage portion, together with the supply reel, the feed roll and the laying aggregate is, after laying each layer, rotated through 180°. The laying aggregate has to be constructed in such a manner that it permits laying in two opposite directions because otherwise the individual layers could not be laid in the same laying direction.

It is a disadvantage of the web laying machine according to the German Offenlegungsschrift No. 2,922,930 that the laying table projects on both sides of the web stack beyond the web laying machine at least by the width thereof because, due to the rotation of the upper laying carriage portion together with the laying aggregate, the laying machine must be capable of moving transversely beyond the web stack in both directions. It is a further disadvantage of this machine that, because of the turning of the laying aggregate together with the upper laying carriage part, that side also changes continuously on which the laying aggregate lays the web and thus a visual monitoring of the web stack, for example, to detect defects, is more difficult. This is particularly the case if the laying aggregate lays the web upstream of the laying carriage—as viewed in the laying direction—and the operating person may visually monitor only that part of the web which is visible downstream of the laying carriage. Consequently, cutting out the defective web areas is also significantly more difficult.

It is a further disadvantage of the known web laying machine that in case of different unwinding directions of the supply reels, a different positioning thereof above the feed roll is necessary because dependent upon the unwinding direction, the web hangs from the supply reel on different sides of the axis thereof and therefore its distance from the feed roll will differ by the thickness of the supply reel.

The above-discussed disadvantages are eliminated from another known web laying machine in which the laying aggregate as well as the supply roll are non-shiftably mounted on the carriage chassis. The upper laying carriage portion carries only the support mechanism for the supply reel which is situated directly above a rotary point defined by the rotary axis of the upper laying carriage portion and is non-shiftably mounted thereon. In order to guide the web, taken from the supply reel, in the zone of the feed roll for the purpose of threading, the upper laying carriage portion is further provided with a conveyor belt situated underneath the supply reel and extending parallel to the laying direction. The conveyor belt advances the web, hanging from the supply reel, in the direction of the feed roll so that thereafter the web will hang from a front edge of the conveyor belt situated above the feed roll, onto one side of the feed roll and may be trained around the feed roll by means of a deflecting roller movable above the feed roll.

In the pairwise web laying by such a laying machine, for performing a web reversal after laying a web layer, the web is rewound on the supply reel, that is, the web is pulled out (unthreaded) from the laying mechanism, then the upper laying carriage portion is rotated 180° and thereafter the web is again threaded into the laying mechanism so that the new layer may be deposited in the same direction as the previous layer, but with the web faces reversed. This then means that for a substantially automated reversal of the web subsequent to the laying of a web layer, the unthreading of the web from, and its rethreading into the laying mechanism and the rotation of the upper laying carriage portion by 180° has to be performed automatically.

In an upper laying carriage portion of the above-outlined construction, however, difficulties are encountered during the threading as well as during the web laying as concerns a synchronization of the delivery speed of the web, the speed with which the web is unwound as well as the rpm of the feed roll.

During the unthreading and threading of the web in the above-outlined machine, the supply speed of the web has to be greater than the unwinding speed with which the web runs off the supply reel, because otherwise risks are high that the web will be positioned obliquely on the conveyor belt and thus the web would hang at an inclination in the zone of the feed roll and also, it would be threaded in an oblique orientation. Such occurrences are undesired because during the subsequent laying of the web, folds in the individual layers may appear. Further, the conveyor belt has to be continuously driven during the web laying because a frontal edge of the conveyor belt situated above the supply roll serves as a deflecting edge for the web pulled from the supply reel to the feed roll. In such a case the unwinding speed from the supply reel and the speed of the conveyor belt must be accurately synchronized with the rpm of the feed roll which, in turn, has to be coupled with the travelling speed of the laying carriage. Otherwise, risks are high that during the laying operation the web, because of an insufficient synchronization of the individual speeds, is brought to the feed roll misaligned or with folds which eventually result in a non-uniform laying or the formation of folds in the layers.

SUMMARY OF THE INVENTION

It is an object of the invention to provide an improved, automatically threading web laying machine, also adapted to perform pairwise laying, which ensures that a non-uniform intake of the web into the laying mechanism for all practical purposes cannot occur either during web threading or during web laying.

This object and others to become apparent as the specification progresses, are accomplished by the invention, according to which, briefly stated, the web laying machine has a laying carriage driven back-and-forth over the laying table in a web laying direction. The laying carriage includes a chassis, an upper part mounted on the chassis and movable transversely to the laying direction relative to the chassis and rotatable about a vertical axis. A sled, carrying a support mechanism for a web supply reel is arranged on the upper part, and has a first position and a second position spaced from the first position in a direction parallel to the laying direction. The sled is movable from the one to the other position by rotating the upper part through an angle of 180° or by linearly displacing the sled relative to the upper part. A web guide mechanism extends transversely to the laying direction and is supported on the sled underneath the support mechanism for causing the web to hang from the sled at approximately the same location thereof independently from an unwinding direction of the supply reel and for causing a leading end of the web to be positioned in a web intake zone of a feed roll which is supported on the chassis and which is rotated as a function of the travelling speed of the carriage.

The invention has the advantage that no problems concerning an irregular feed and threading of the web are encountered because the web, by virtue of its hanging from the carriage, is pulled smooth by itself and further, the disadvantages of the web laying machine according to the German Offenlegungsschrift No. 2,922,930 are avoided because the laying aggregate is not turning with the sled, and because by means of the guide element mounted additionally underneath the sled it is ensured that the web at all times hangs such that it is at a constant distance from the feed roll.

No web laying machines have been heretofore constructed with a longitudinal web pull control offering the possibility of an automatic threading of the web. Therefore, according to a further feature of the invention, a compensating roller arrangement is provided; more particularly, with both sled positions a separate compensating roller is associated for controlling the drive mechanism. Depending on whether the sled is in its one or other position, a respective compensating roller is in a working position while the other compensating roller idles. In such a web laying machine, in a first sled position the web may be threaded into the laying mechanism encompassing the feed roll and the laying aggregate, without interfering with the compensating roller associated with that sled position. Thereafter, the sled, for performing the web laying proper, is shifted into its second position, whereby the web is, in a simple manner, pulled over the compensating roller associated with the last named sled position and simultaneously this compensating roller is rendered effective. In addition to the very simple threading of the web into the longitudinal pull control arrangement, it is a principal advantage of this construction that during the pairwise laying, subsequent to cutting and rewinding the web from the laying mechanism, the upper laying carriage portion needs to be rotated only through 180° in order to bring the sled again into its threading position. Thus, for this operation no linear travel of the sled is required.

The compensating rollers may be brought into their operative or idling positions, for example, by means of electric drive mechanisms controlled by the sled. According to a preferred further feature of the invention, however, the compensating rollers are supported on rockers spring-biased in the direction of the web, and further, in each of the two sled positions the rockers of one of the compensating rollers are, against the force of the rocker spring, pressed down by the sled into the idling position.

Since the web has to be looped about the feed roll through a predetermined circumferential angle thereof during the web laying operation, it is feasible to so proceed that in the threading position of the sled, the leading end of the web hanging from the supply reel first hangs behind the feed roll (as viewed in the travelling direction of the laying carriage during web laying) and then the sled, as the supply reel rotates and the feed roll remains stationary, is shifted forwardly only to such an extent until the web lies over the feed roll and has formed a loop therebehind. A positive determination of the loop angle of the feed roll by the web is ensured even upon starting or braking the laying carriage and the leading end of the web will hang behind the feed roll in the threading position, by providing a web deflecting roller which is arranged above the feed roll and which may be moved from an idling position into a working position. By means of the deflecting roller the web may be brought into a position in which it is partially trained about the feed roll.

The supply reel, for unwinding the web therefrom, may be mounted on a shaft which is driven with a variable rpm in such a manner that the web supply speed remains constant despite the decreasing diameter of the supply reel. According to a preferred embodiment of the invention, however, for unwinding the web a drive roll is provided which may be brought into a circumferential engagement with the supply reel. In order to ensure in a simple manner that the circumference of the supply reel is at all times in engagement with the drive roll, the supporting device carried by the sled has, for the supply reel shaft, a guide mechanism which is oriented in the direction of the drive roller obliquely with respect to the horizontal. In order to set and, if required, to maintain constant the pressing force between the supply reel and the drive roll, the inclination of the supply reel guide may be varied, and a motor-driven shifting mechanism may be provided for setting the inclination of the supply reel guide.

If, during the automatic threading of the leading end of the web into the laying mechanism, the direction of rotation of the supply reel, effected by the drive mechanism, does not correspond to the direction of unwinding, according to a preferred embodiment of the invention, such an occurrence may be corrected by providing, underneath the supply reel and above the feed roll, a first sensor device for responding to the leading end of the web to effect a reversal of the driving device for unwinding the supply reel. Such a sensor device may preferably comprise an optical barrier which, after a predetermined number of revolutions of the supply reel or, preferably, after a lapse of a certain period determined by a timing element (started upon energization of the drive for unwinding the supply reel), is required to emit a signal representing the unwinding direction.

So-called edge controls are known expedients in web laying machines: they comprise usually two optical barriers which are arranged at a small distance from one another transversely to the direction of advance of the web in the zone of a longitudinal web edge and which control an adjusting device by means of which the supply reel is shifted in the axial direction until only one of the two optical barriers senses the presence of the web. This principle is utilized in the laying machine according to the invention, wherein the upper laying carriage part is shiftable with respect to the laying carriage chassis transversely to the travelling direction of the laying carriage by means of a transverse setting motor, and further, above the feed roll there is provided a second sensor device which senses one of the longitudinal edges of the web and which controls the transverse setting motor. In this manner, the supply reel may be centered before the leading end of the web arrives at the feed roll. Expediently, during the centering process, the drive mechanism for unwinding the supply reel is switched off and in order to time the edge control with precision during the automatic threading, a second timing element is started by means of the first sensor device associated with the leading end, and after the period has lapsed, the drive mechanism for unwinding the supply reel is stopped, whereupon a centering of the supply reel is effected. It is of advantage to provide that the second timing element, upon completion of its run, starts a third timing element which defines the time period available for centering the supply reel and, upon lapse of the period, it again energizes the drive mechanism associated with the unwinding of the supply reel.

Preferably, the feed roll is energized during the threading of the web into the laying system only when the web deflecting roll has already been moved into its working position. This may be triggered by the termination of the run of the third timing element. Since during the automatic threading the laying carriage is normally at a standstill, while the feed roll has to be driven during the laying operation as a function of the travelling speed of the laying carriage, according to a further feature of the invention, the feed roll is disconnected from the runner wheels of the laying carriage by means of a first clutch and is driven by an auxiliary motor with the intermediary of a second clutch. A limit switch sensing the working position of the web deflecting roll disengages the first clutch and engages the second clutch and further, sets in motion the auxiliary motor so that after the web deflecting roll has moved into its working position, both the supply reel and the feed roll rotate and the leading end of the web advances in the direction of the laying aggregate. It is also conceivable that during the centering of the supply reel, the web already hangs downwardly over the feed roll to such an extent that the web deflecting roll may, during standstill of the supply reel, move into its working position and then the drive mechanism for unwinding the supply reel and the auxiliary motor for driving the feed roll may be energized simultaneously. This, however, would involve the disadvantage that the web, due to the shift of the web deflecting roll, is exposed to a significant longitudinal pull which is to be avoided particularly in case of light (delicate) webs. According to a further feature of the invention, thus a first limit switch associated with the working position of the web deflecting roll only energizes the auxiliary motor, whereas the supply reel rotates already during the travel of the deflecting roll into its working position.

In order to save time, particularly during the pairwise laying process, a sled driving motor is provided which is energizable by the first limit switch and which serves for shifting the sled from the threading position into the other sled position so that the supply reel, at the beginning of the laying process, is already in a position into which it may be brought again, above the feed roll and the laying aggregate, by virtue of turning the upper laying carriage portion through 180°.

In order to terminate the threading process, in the zone of the laying aggregate, advantageously a third sensing device associated with the leading end of the web is provided. The third sensing device opens the second clutch and de-energizes the auxiliary motor when the leading end of the web has reached the laying aggregate or has been pushed therethrough. The third sensor device then also causes the first clutch to be engaged, so that the feed roll rotates, during the web laying, with a speed corresponding to the travelling speed of the laying carriage. Further, the third sensor device may be also used to de-energize the drive mechanism for unwinding the supply reel at the end of the threading operation. Laying aggregates usually have a clamping mechanism for the web. Advantageously, such a clamping mechanism is used with the laying machine according to the invention and is actuated by signals from the third sensor device.

DESCRIPTION OF THE PREFERRED EMBODIMENT

Figure 1:
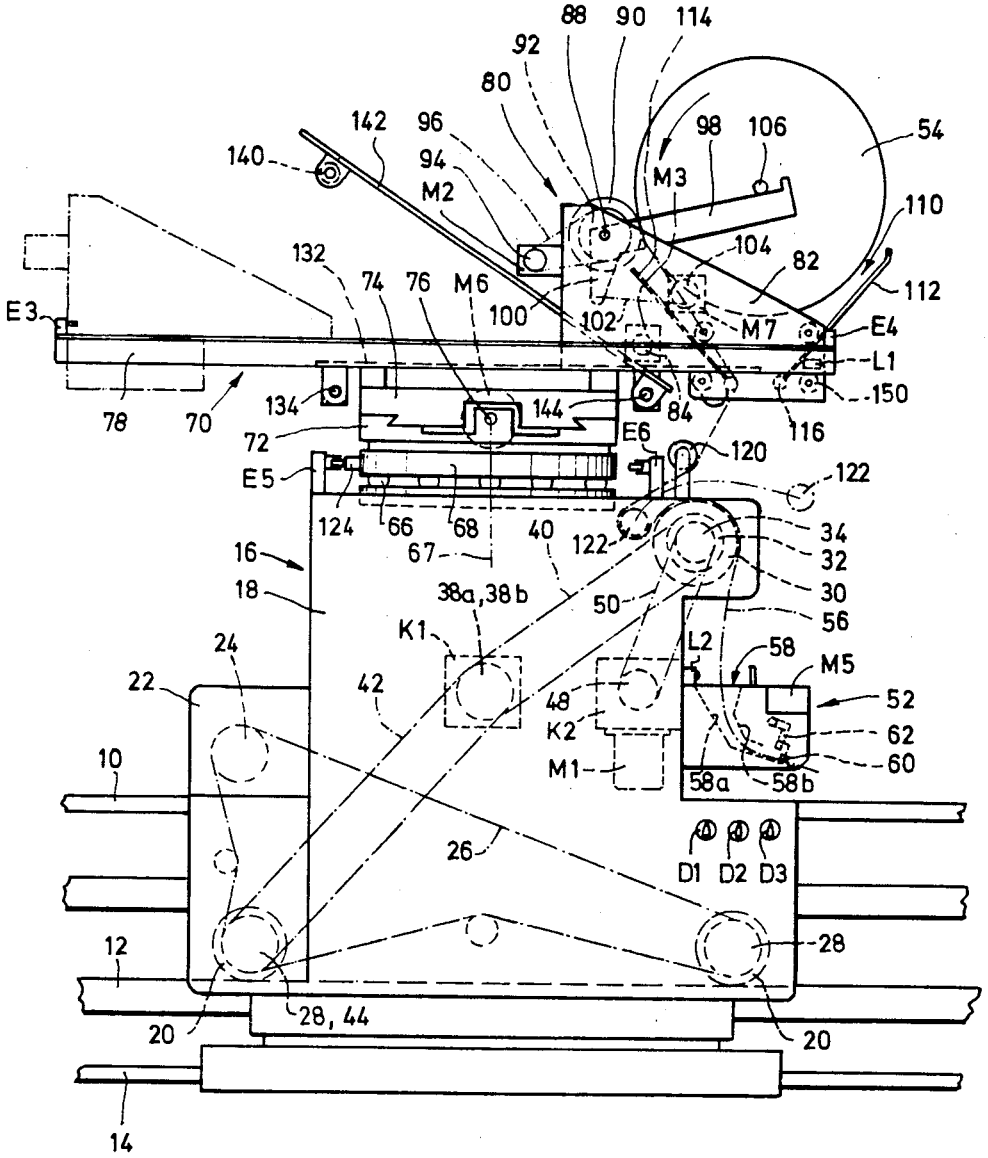
FIGS. 1, 2, 3 and 4 are schematic side elevational views of a preferred embodiment of the invention, illustrating different operational positions thereof.

Turning now to FIG. 1, there is shown one longitudinal side of a laying table 10 which is supported by a machine frame (not shown) and on the horizontal surface of which a web 56 is to be deposited in layers. On the machine frame, underneath the table 10, on either side of the length dimension thereof, a carrier rail 12 and a guide rail 14 are secured. The rails 12 and 14 which extend in the longitudinal direction, that is, in the direction of web laying, serve for the support and guidance of a laying carriage designated generally as a whole at 16. The laying carriage 16 has a lower portion constituted by a laying carriage chassis 18 which extends above and transversely across the laying table 10 and which carries, on either side of the laying table 10, runner wheels 20, by means of which the laying carriage 16 is supported on the carrier rails 12. For propelling the laying carriage 16, on the laying carriage chassis 18 there is mounted a motor 22 having an output shaft which carries a sprocket 24 driving, by means of a chain 26, sprockets 28 which are affixed to one pair of the runner wheels 20.

The laying carriage chassis 18 further supports a rotatable feed roll 30 having a shaft on which there are fixedly mounted two sprockets 32 and 34. The laying carriage chassis 18 further supports a clutch K1 by means of which two coaxially arranged sprockets **38*a* and 38*b* may be coupled to or disconnected from one another. The sprocket 32 is connected with the sprocket 38*a* by a chain 40, whereas about the sprocket 38*b* there is trained a chain 42 which is also trained about a sprocket 44 arranged coaxially with the left sprocket 28 (as seen in FIG. 1**) and is rotatable therewith as a unit.

Thus, with the intermediary of the clutch K1 the feed roll 30 may be driven by the runner wheels 20, as a function of the travelling speed of the laying carriage 16. The various sprocket diameters and the diameter of the feed roll 30 are so coordinated with one another that the circumferential speed of the feed roll 30 corresponds to the travelling speed of the laying carriage 16 when the feed roll 30 is driven by the runner wheels 20. The clutch K1 further may contain a gearing with a steplessly variable transmission ratio to take into account a slippage of the web on the feed roll 30. For an automatic threading of the leading end of the web an auxiliary motor M1 is provided for the feed roll 30. The motor M1 drives, by means of a clutch K2, a sprocket 48 which is connected with the sprocket 34 by means of a chain 50. The motor M1 may be flanged to the clutch K2 while the latter is, in turn, mounted on a lateral wall of the laying carriage chassis 18.

On the laying carriage chassis 18 there is mounted a laying aggregate 52 which is displaceable vertically in a conventional manner with respect to the laying carriage chassis 18. A mechanism (not shown) is provided to immobilize the laying aggregate 52 in a set height position. The laying aggregate 52, similarly to the feed roll 30, extends above and across the laying table 10 and serves for deflecting the web 56 of indeterminate length, taken off a supply reel 54. For this purpose, the laying aggregate 52 has a funnel 58 which extends above and transversely across the table 10 and which is formed of side walls **58*a* and 58*b*. The web 56 is introduced into the funnel 58 from above and is then deflected at an angle of approximately 90° by the side wall 58*a* and is eventually discharged rightward from a slot (not shown) in the laying aggregate 52, as viewed in FIG. 1. A clamping bar 60, extending in the longitudinal direction of the laying aggregate 52 (that is, transversely to the length of the table 10) may be pressed against the side wall 58*a* in order to immobilize the web 56. The clamping bar 60 is mounted on pivotal arms 62 which, by means of a motor M5, may be pivoted counterclockwise from the working position shown in FIG. 1 into an inoperative position in which it releases the web 56. The laying aggregate 52** is, in its details described up to this point, a conventional component of current web laying machines, and consequently, a more detailed description and illustration thereof are dispensed with.

According to the invention, the laying aggregate 52 carries an optical gate L2 to respond to the presence of the transverse edge of a leading end of the web 56 hanging from the supply reel 54.

Figure 7:
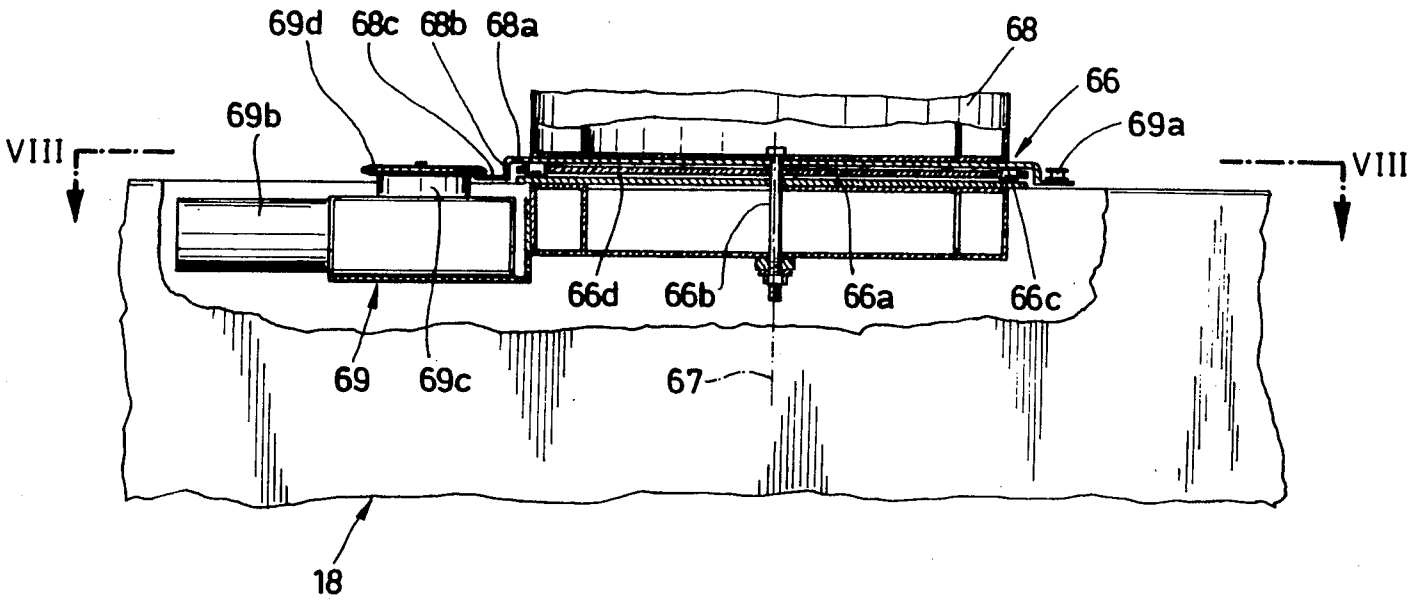
FIG. 7 is a broken-away side elevational view, partially in section, of an enlarged detail of the construction shown in FIG. 1.
Figure 8:
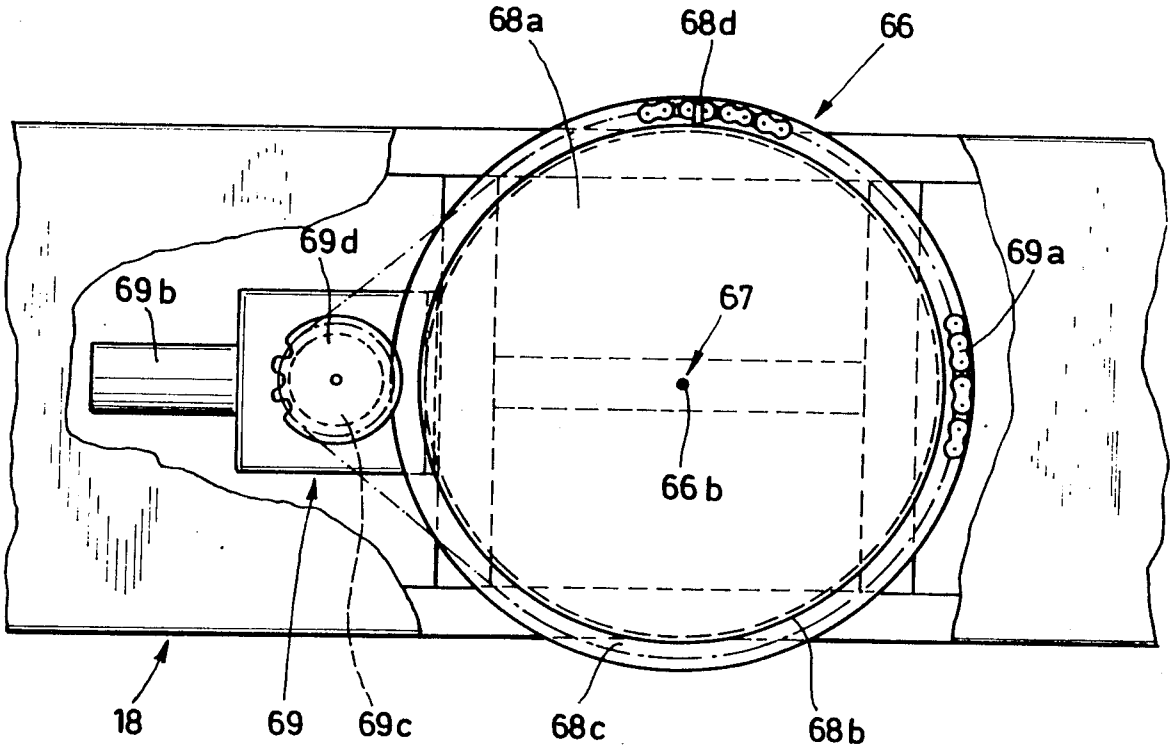
FIG. 8 is a sectional view taken along line VIII—VIII of FIG. 7.

Also referring to FIGS. 7 and 8, the laying carriage chassis 18 further supports, by means of a bearing 66, a carousel 68 rotatable about a vertical axis 67. The bearing 66 comprises a substantially horizontally extending plate 66*a* which is supported on the laying carriage chassis 18 and an upright spindle 66*b* supported on the laying carriage chassis 18 and arranged coaxially with the vertical axis 67. On the plate 66*a* runs a circular assembly of rollers 66*c* which are guided in a roller cage 66*d* supported rotatably on the upright spindle 66*b*.

The carousel 68 is supported on the rollers 66*c* by means of a disc 68*a* which extends parallel to the plate 66*a*, and which is also rotatably supported on the spindle 66*b*. The disc 68*a* thus transmits, to the rollers 66*c*, forces which extend parallel to the vertical axis 67.

An edge 68*b* of the disc 68*a* is crimped downwardly in the direction of the plate 66*a*, whereby the edge 68*b* extends parallel to the vertical axis 67 and partially covers the roller assembly 66*c*. On the edge 68*b* there is provided a guide ring 68*c*, whose horizontal annular upper face serves as a guide for a drive chain 69*a*. The guide ring 68*c* extends parallel to the plate 66*a* and is concentric with the vertical axis 67.

A drive 69 for rotating the carousel 68 includes a drive motor 69*b* which has a shaft 69*c* extending parallel to the vertical axis 67 and carrying a drive pinion 69*d* meshing with the drive chain 69*a*.

Thus, the drive chain 69*a* is trained about the drive pinion 69*d* and extends therefrom about the disc 68*a* while lying against the vertical edge 68*b* and being secured by the guide ring 68*c* against slipping downwardly.

The drive chain 69*a* is secured to the disc 68*a* by a shackle 68*d* which is held on the disc edge 68*b* in such a manner that the carousel 68 is rotatable by the drive motor 69*b* via the drive chain 69*a* through an angle of 180° in each of two opposite directions.

Reverting once again to FIGS. 1 and 2, the carousel 68 is a component of an upper laying carriage portion 70 and carries a transversal guide bed 72 which guides a sled 74 by means of a dovetail joint for transverse shifting motions (that is, displacements which are perpendicular to the drawing plane of FIG. 1). For displacing the transverse sled 74 there is provided a motor M6 mounted on the transverse guide bed 72. The motor M6 drives a threaded spindle 76 threadedly engaging a nut (not shown) affixed to the transverse sled 74. On the latter there are secured, in sequence in a direction perpendicular to the plane of FIG. 1 and spaced transversely from one another, two longitudinal carrier beams 78 which serve as guide rails and on which there is supported a longitudinal sled 80 for longitudinal travel thereon. The longitudinal sled 80 forms a frame with two side walls 82 which are arranged side-by-side, as viewed perpendicularly to the plane of FIG. 1. The distance between the side walls 82 is slightly greater than the maximum expected width of the web 56 to be laid. The transverse distance between the longitudinal carriers 78 corresponds approximately to that of the lateral walls 82. To one of the side walls 82 there is mounted a motor M3 which has an output pinion 84 in a meshing relationship with a toothed rack secured to the frontal longitudinal carrier 78, whereby the longitudinal sled 80 may travel back and forth on the carriers 78. Between the lateral walls 82, at an upper part thereof, there is affixed a shaft 88 which serves for supporting a drive roll 90 which is fixedly connected with a coaxial sprocket 92. The latter is driven by an output sprocket 94 of a motor M2 with the intermediary of a chain 96. On the shaft 82 on both sides of the drive roll 90 there are rotatably supported two carrier rockers 98 each having a downwardly oriented setting arm 100. The two setting arms 100 are connected with one another by means of a non-illustrated bar which is oriented parallel to the shaft 88. To the frontal setting arm 100 (as viewed in FIG. 1) there is secured a cable 102 whose other end is affixed to a winch shaft 104 of a motor M7 for varying the inclination of the carrier rockers 98. The latter support a shaft 106 which carries the supply reel 54 rotatable about the shaft 106. By virtue of the downward inclination of the carrier rockers 98 the supply reel 54 at all times engages, with its circumferential surface, the circumferential surface of the drive roll 90. Thus, the pressing force between the two components may be set by the inclination of the carrier rockers 98.

Between the lateral walls 82 of the longitudinal sled 80 there are secured, underneath the supply reel 54, sheet metal walls 112, 114 which constitute a funnel 110 and which terminate, in the downward direction, in deflecting rolls 116 for the web 56. In the funnel wall 112 there is provided a window for transmitting light of an optical barrier L1 with which there may be associated a reflector on the other funnel wall 114. Between the deflecting rolls 116 and the feed roll 30 there is arranged a rotatably supported deflecting roll 120 which is non-shiftably held on the laying carriage chassis 18 as well as a deflecting roll 122 which may be pivoted between a right-hand position of rest and a left-hand working position and whose support will be described in more detail later.

Figure 2:
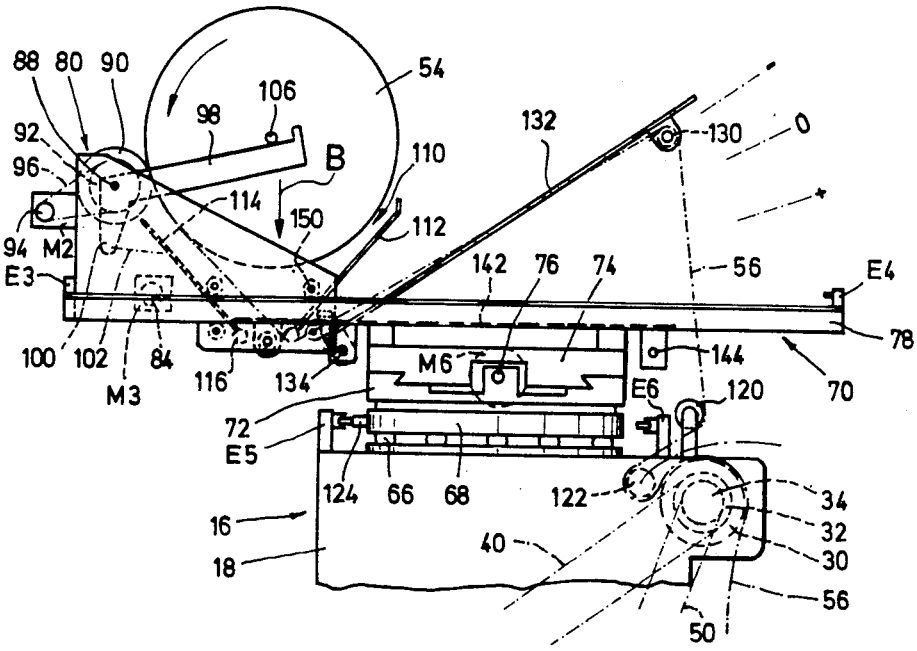
Figure 3:
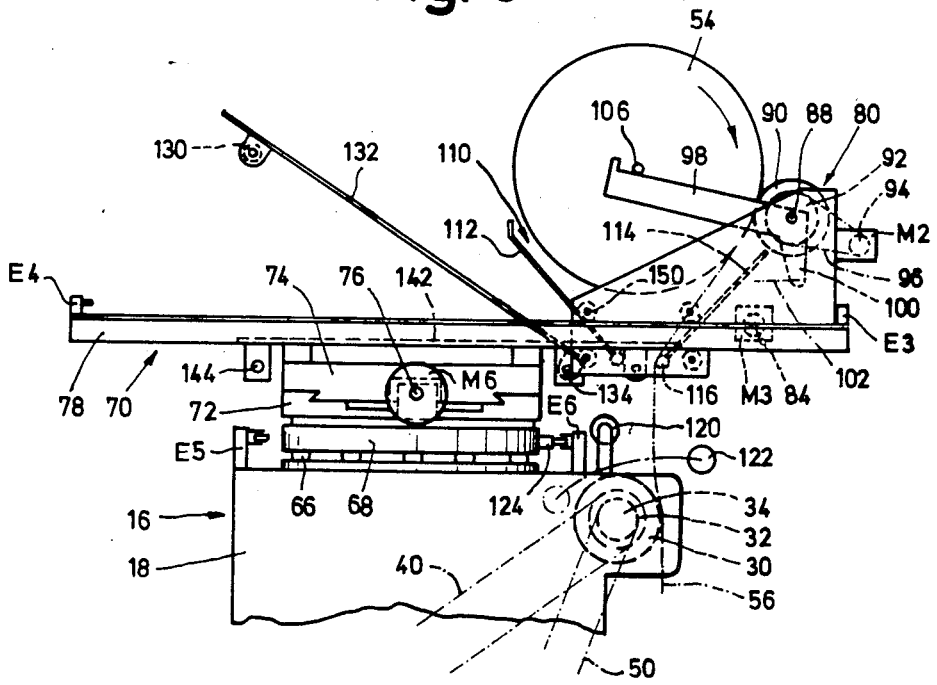
Figure 4:
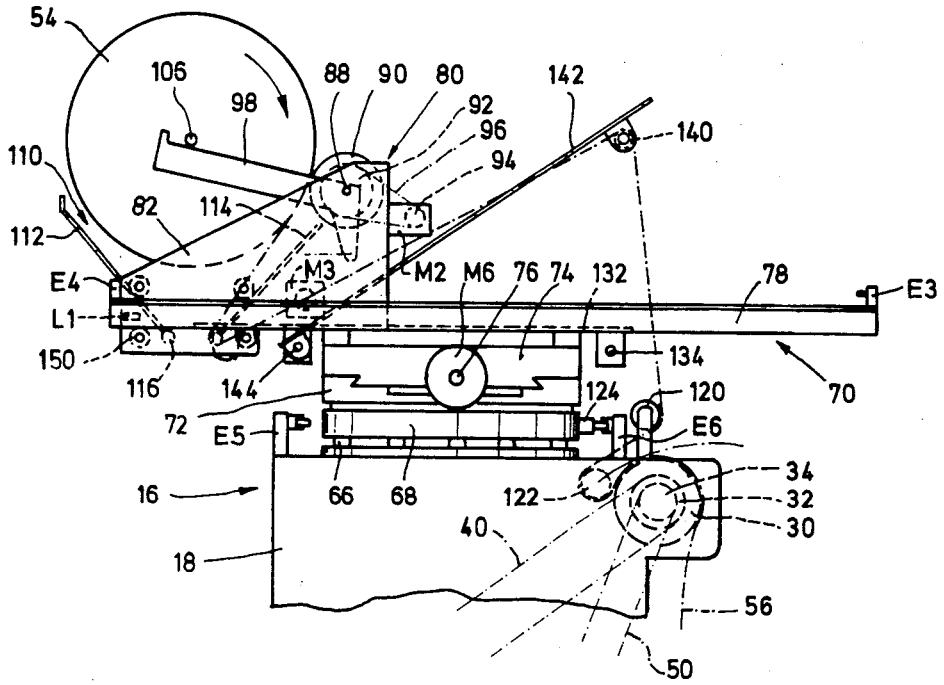

With the two positions of the carousel 68 illustrated in FIGS. 1 and 3, there are associated respective limit switches E5 and E6 which are actuated by a lug 124 affixed to the carousel 68 and which serve for de-energizing the drive motor 69*b* which rotates the carousel 68. With the two end positions of the longitudinal sled 80 shown in FIGS. 1 and 2 there are associated respective limit switches E3 and E4 which are mounted on the longitudinal carrier 78 and which may be actuated by one of the side walls 82 of the longitudinal sled 80. The limit switches E3 and E4 serve for de-energizing the motor M3.

According to the invention, with each end position of the longitudinal sled 80 there is associated a compensating roller, by means of which the longitudinal tension of the web 56 may be regulated during the laying operation. Thus, with the end position of the longitudinal sled 80 defined by the limit switch E3 and shown in FIG. 2, there is associated a first compensating roller 130 which—as viewed in the plan view of FIG. 9—extends between the longitudinal carriers 78 parallel to the shaft 88 and which, at its two opposite ends, is rotatably supported in first compensating rockers 132. The latter, in turn, are supported in compensating rocker supports 134 secured to the longitudinal carrier 78 and are, by non-illustrated springs, urged in a counterclockwise direction from a horizontal position. In the zone of one of the two compensating rocker supports 134 there is arranged a setting element, particularly a rotary potentiometer 135 which is operated by one of the compensating rockers 132 and which controls the rpm of the motor M2. In FIG. 2 there are illustrated three positions of the compensating rockers 132 in dashed-dotted lines: a mid-position designated at "0" in which the motor M2 runs with a normal rpm approximately synchronized with the rpm of the feed roll 30, a position above the "0" position which is designated at "−" and in which the longitudinal tension of the web 56 is small and accordingly, the rpm of the motor M2 is decreased, as well as a "+" position which is situated underneath the mid-position and in which the longitudinal tension of the web 56 is excessive and accordingly, the rpm of the motor M2 is increased by means of the rotary potentiometer 135 or a similar component.

Figure 9:
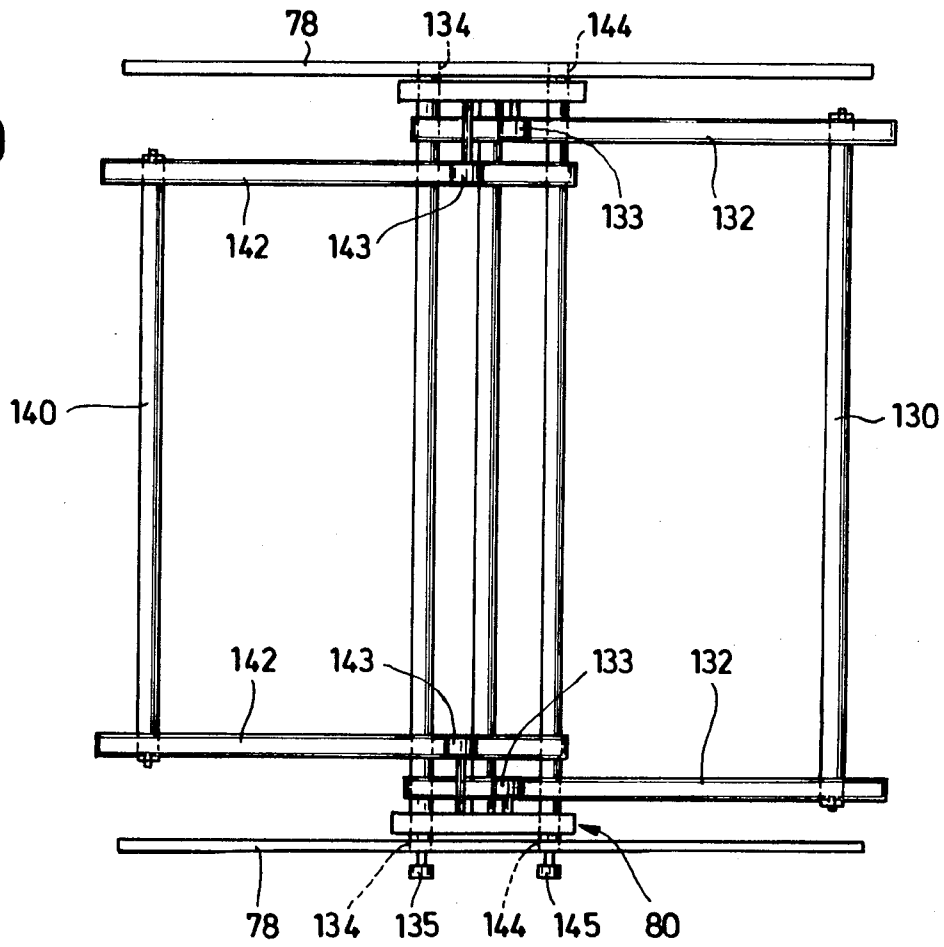
FIG. 9 is a top plan view of an enlarged detail of the construction shown in FIG. 1.

The longitudinal sled 80, in the position illustrated in FIG. 1, holds the first compensating rockers 132 by means of a pair of rollers 133 (FIG. 9) against the force of compensating rocker springs in an inoperative, approximately horizontal position of rest. The longitudinal sled 80, as it moves into its end position determined by the limit switch E3 and illustrated in FIG. 2, releases the first compensating rockers 132. For this purpose, the roller pair 133 is arranged on the longitudinal sled 80 in such a manner that at all times the rollers 133 are at the same distance from the respective carrier 78 as the compensating rocker 132 associated therewith (as shown in FIG. 9), so that upon displacement of the longitudinal sled 80, for example, from the position shown in FIG. 2 into the position shown in FIG. 1, the rollers 133 engage the compensating rockers 132 and press them downwardly in a clockwise direction.

The rollers 133 are arranged on the longitudinal sled 80 at such a distance above the compensating rockers 132 that the rollers 133 maintain the compensating rockers 132, in the position of the longitudinal sled 180 shown in FIG. 1, in their inoperative, approximately horizontal position of rest and the compensating rockers 132 are released to permit an upward, counterclockwise swinging motion essentially only when the rollers 133, upon travel of the longitudinal sled 80 from the position shown in FIG. 1 into the position shown in FIG. 2, have passed the compensating rocker bearing 134.

In a similar manner, with the end position defined by the limit switch E4 and shown in FIG. 1, two second compensating rockers 142 are associated with a second compensating roller 140. For the second compensating rockers 142 there are provided compensating rocker bearings 144 with a rotary potentiometer 145 (FIG. 9) on the longitudinal carriers 78 and further, the longitudinal sled 80 has a second roller pair 143 for holding down the second compensating rockers 142 in the same manner as the first roller pair 133 when the longitudinal sled 80 releases the first compensating rockers 132. The operation of the compensating roller 140 is identical to that of the compensating roller 130. The latter may become effective only when the limit switch E3 is actuated, whereas the second compensating roller 140 may become effective only when the limit switch E4 is actuated.

In order to ensure that the longitudinal sled 80 moves on the longitudinal carriers 78 with low friction, the longitudinal sled 80 is provided on each side with four runners engaging upper and lower tracks of each longitudinal carrier 78.

Figure 5:
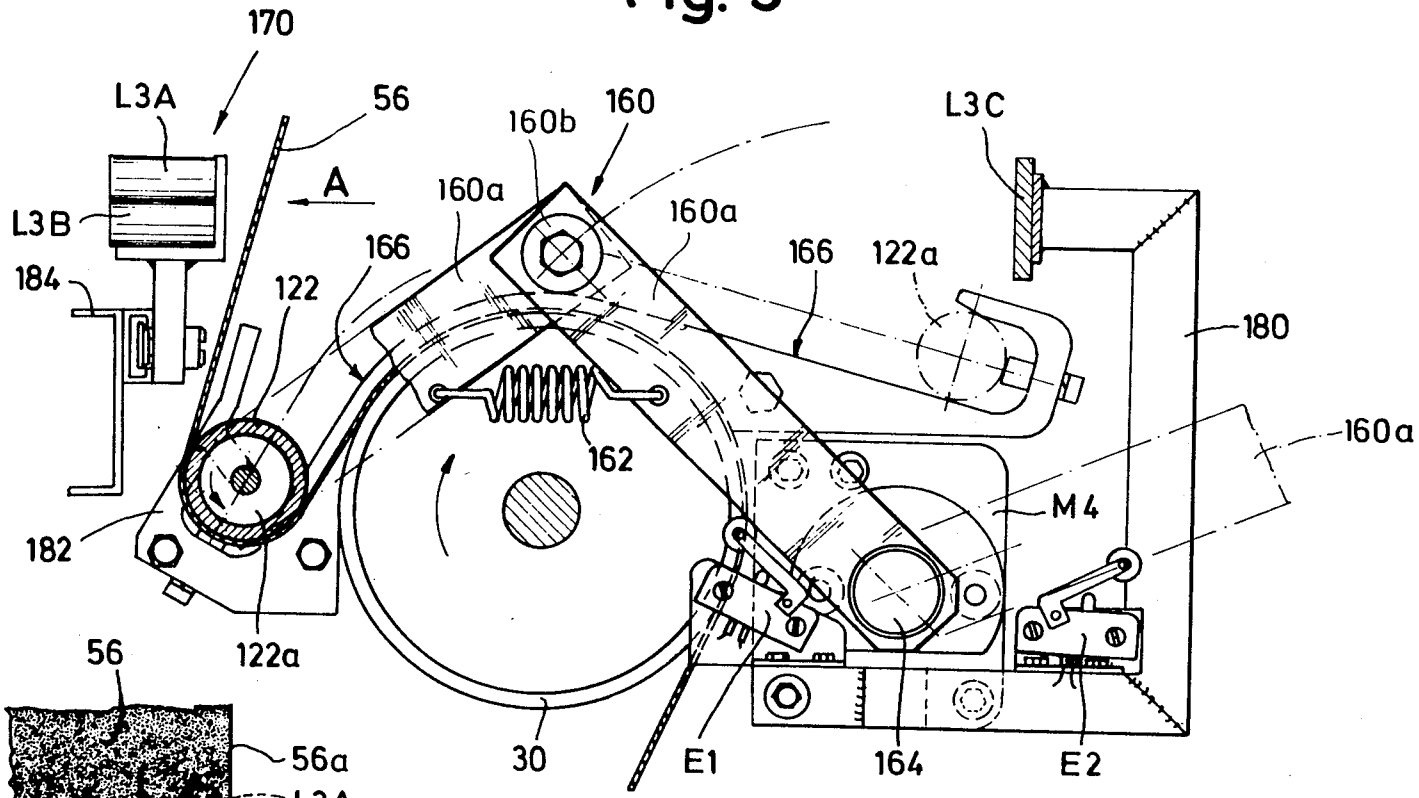
FIG. 5 is a side elevational view, partially in section, of an enlarged detail of the construction shown in FIG. 1.

Turning now to FIG. 5, the deflecting roll 122 is supported at each end in pivotal rockers 160, each formed of two articulated links 160*a*. The links 160*a* of each rocker 160 are, under the effect of tension springs 162, urged to pivot inwardly about the articulation 160*b*. The rockers 160 are secured to a common shaft 164 which is driven by a motor M4. Under the effect of the tension springs 162 the deflecting roll 122 is, with the end zones of its core 122*a*, in continuous engagement with stationary cam tracks 166 which determine the course of motion of the deflecting roll 122. In FIG. 5, the deflecting roll 122 and the articulated rockers 160 are shown in solid lines in the working position and in dash-dotted lines in the inoperative position.

Figure 6:
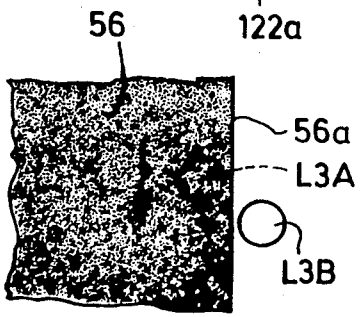
FIG. 6 is a fragmentary view in the direction of the arrow A in FIG. 5.

In FIGS. 5 and 6 there is illustrated a sensor device 170 for responding to the presence of a longitudinal edge 56*a* of the web 56. The sensor device 170 comprises optical barriers L3A and L3B which are above one another and are offset transversely, as viewed in the direction of the web advance. With the optical barriers L3A and L3B there is associated a common reflector L3C. The optical barriers L3A and L3B control the motor M6 for shifting the transverse sled 74 in such a manner as to ensure that the longitudinal edge 56*a* of the web 56 extends between the two optical barriers L3A and L3B. The carriers 180, 182 and 184 associated with various elements for supporting the deflecting roll 122 and the sensor device 170 are in their entirety secured to the laying carriage chassis 18. The carrier 180 further supports two limit switches E1 and E2 which are alternatingly in the working position (shown in FIG. 5 for E1) and in the position of rest (shown in FIG. 5 for E2). The limit switches E1, E2 are actuated by one of the rockers 160.

In the description which follows, the web laying method according to the invention as well as the mode of operation of the described web laying machine will be set forth, and reference will also be made to FIGS. 10A–C, 11, 12A, B and 13A–D which illustrate electric controls for the various machine components. It is noted that viewing FIGS. 10A–10C together, lines R–A (FIG. 10A), A–C (FIG. 10B) and C–R (FIG. 10C) represent a single conductor R of a 3-phase current supply R, S, T, whereas lines Mp–B (FIG. 10A), B–D (FIG. 10B) and D–Mp (FIG. 10C) represent the single ground conductor Mp of the 3-phase supply. Further, contacts controlled or actuated by the particular relays S, optical barriers L, limit switches E as well as switches D are provided with the same reference characters as their devices by which they are controlled or actuated. Dual parallel lines or broken lines indicate mechanical connections.

First, the automatic threading method will be discussed which is initiated, for example, by actuating a manual switch D1 (FIGS. 1 and 10A) mounted on the laying carriage 16. The closing of the switch D1 causes energization of the motor M2, whereby the supply reel 54 starts its rotation. At the same time, a timing element T1 is started by means of which the sense of rotation of the motor M2 is reversed if upon a lapse of the time interval associated with the time element T1 the optical barrier L1 has not yet sensed the beginning (leading edge) of the web 56. This would mean that the supply reel 54 is rotating in the winding direction rather than in the required unwinding direction.

In case the light barrier L1 responds (by sensing the presence of the leading edge of the web 56), a second timing element T2 starts running, whose time interval Z2 is so measured that the leading edge of the web 56 can arrive approximately to the height of the axis of the feed roll 30 and thus hangs towards the right from the feed roll 30 (FIG. 1), and further, the presence of one longitudinal edge of the web 56 is sensed by the sensor device 170 (L3A and L3B shown in FIGS. 5, 6 and 12A) for the web edge control. Upon lapse of the time interval Z2 the time element T2 de-energizes the motor M2 via a relay S6 and starts the run of a time element T3 and activates the web edge control. The time interval Z3 defined by the time element T3 is of such a length that the supply reel 54 may be centered by the web edge control. The centering operation is effected by adjusting the position of the transverse sled 74 by the motor M6, controlled by the optical barriers L3A and L3B. A centering has occurred when the longitudinal edge 56a of the web 56 is disposed between the optical barriers L3A and L3B as illustrated in FIG. 6.

Upon lapse of the time interval Z3 the time element T3 energizes the motors M2 (via relay S4 or S5 and relay S6) and M4 (via relay S8) whereupon, as a result, the supply reel 54 again rotates and the deflecting roll 122 is pivoted from its right-hand inoperative position into its left-hand working position as viewed in FIG. 1. Upon this occurrence, one of the articulated rockers 160 actuates the limit switch E1 which again de-energizes the motor M4 (by means of the relay S8). By virtue of the fact that during the inward pivotal motion of the deflecting roll 122 into its working position, the supply reel 54 unwinds a web portion, no longitudinal tension in the web 56 is generated despite the fact that the feed roll 30 is at a standstill. The latter starts its rotation only after actuation of the limit switch E1 because the latter disengages the clutch K1 (FIG. 10B) and engages the clutch K2 and the motor M1 is energized. As a result, both the supply reel 54 and the feed roll 30 are rotated.

Figure 10A:
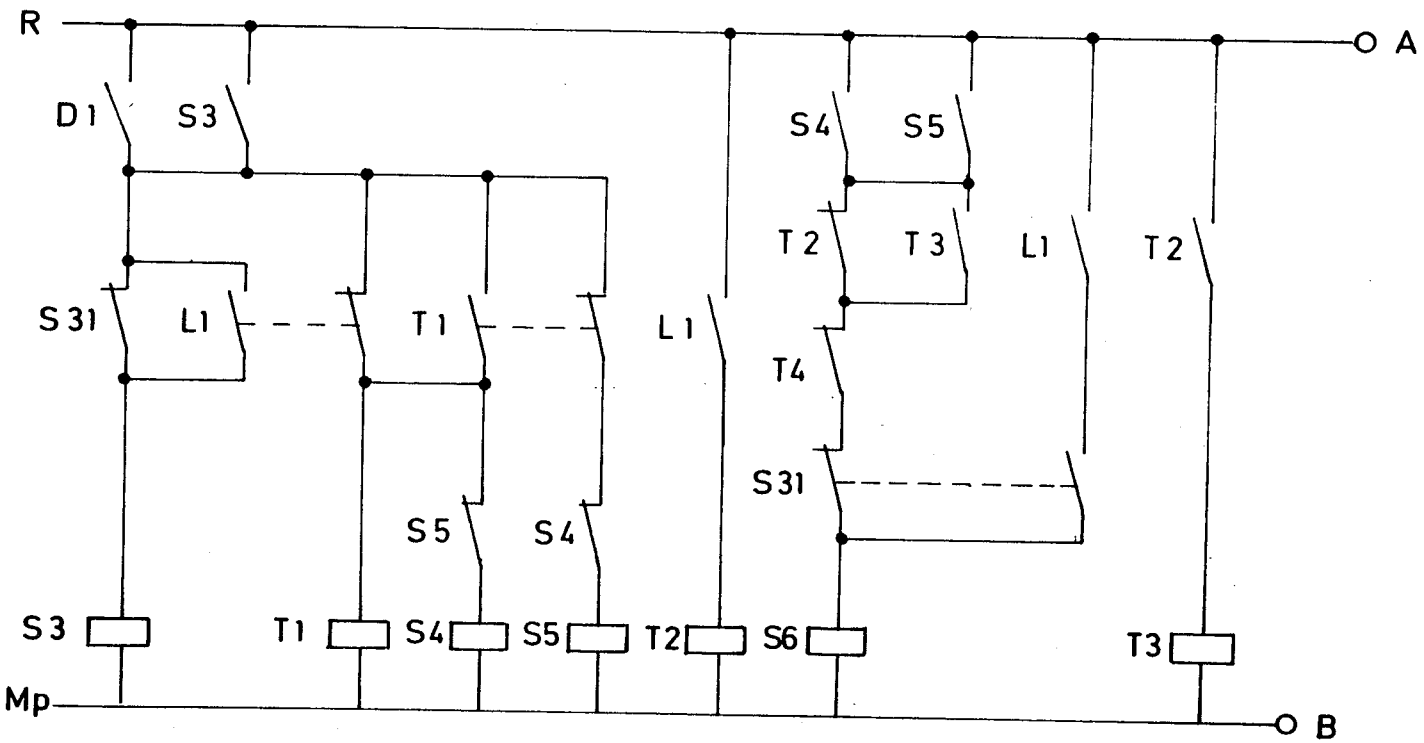
FIGS. 10A, 10B and 10C are schematic circuit diagrams of one part of a machine control circuit for controlling the operation of a component group of the machine according to the invention.
Figure 10B:
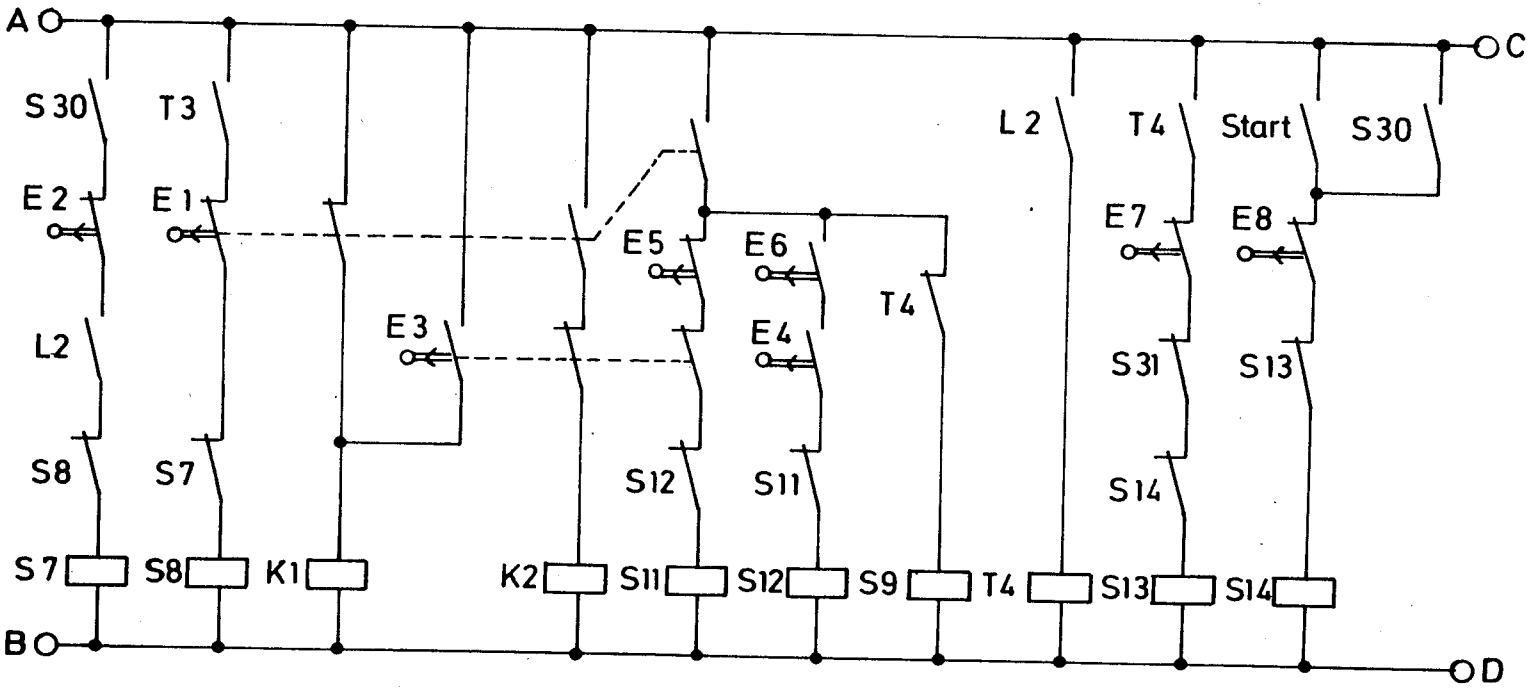
Figure 10C:
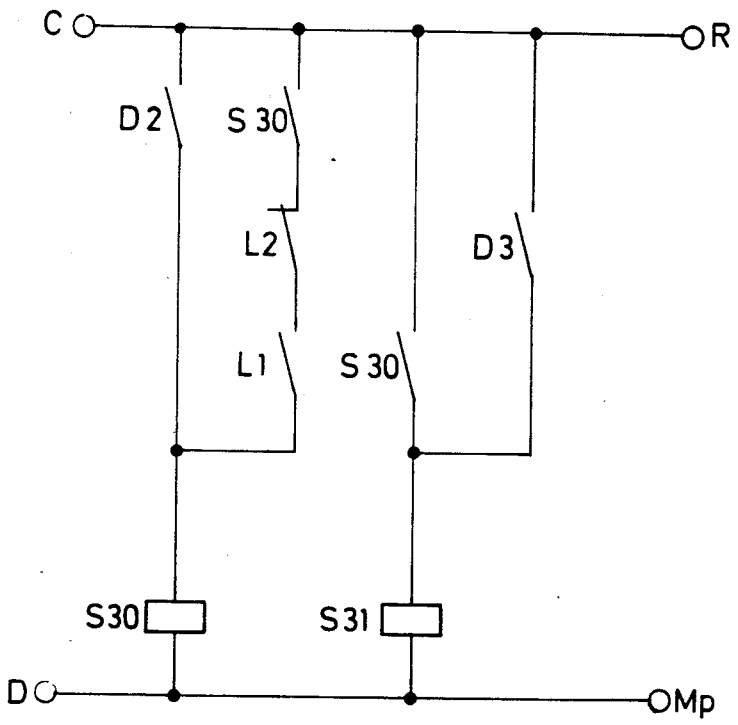
Figure 11:
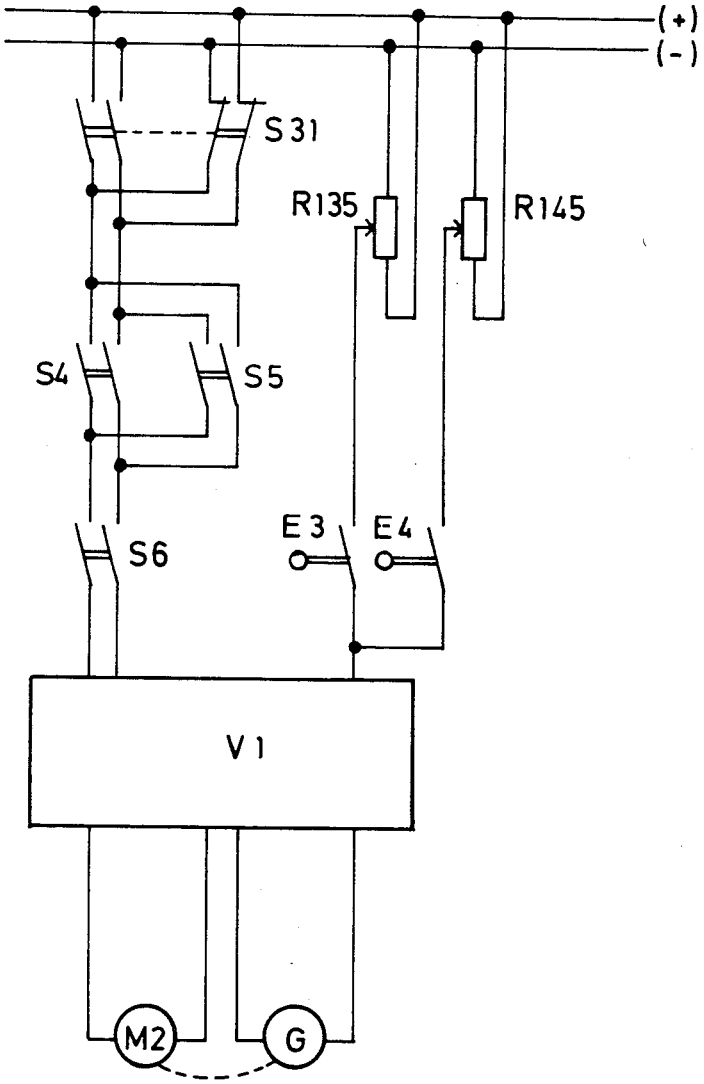
FIG. 11 is a circuit diagram of another part of the machine control circuit for controlling the operation of another component group of the machine according to the invention.
Figure 12A:
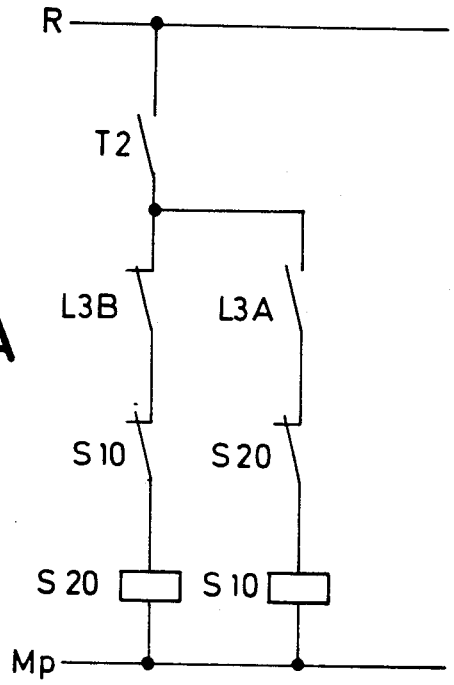
FIGS. 12A and 12B are circuit diagrams of the input and output portions, respectively, of still another part of the machine control circuit for controlling the operation of still another component group of the machine according to the invention.
Figure 12B:
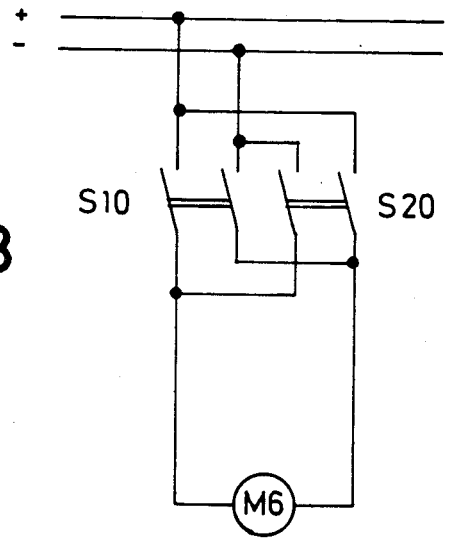
Figure 13A:
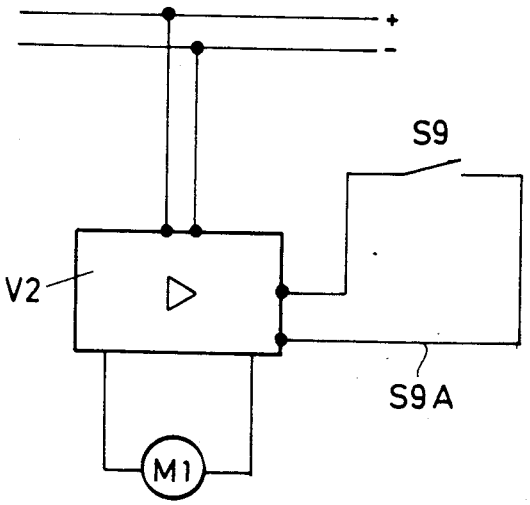
FIGS. 13A, 13B, 13C and 13D are circuit diagrams illustrating the connection of four different motor drives of the preferred embodiment to a respective current source.
Figure 13B:
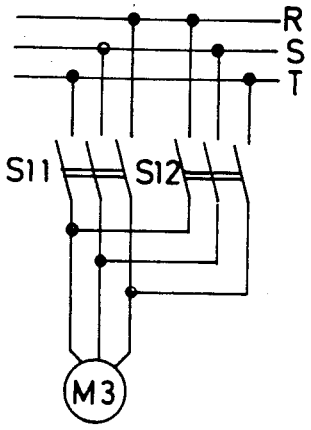
Figure 13C:
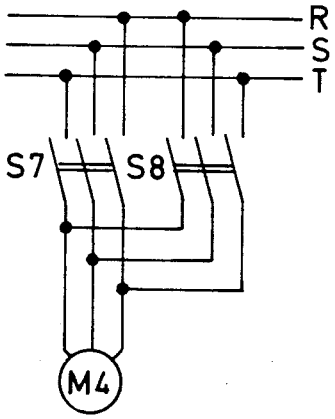
Figure 13D:
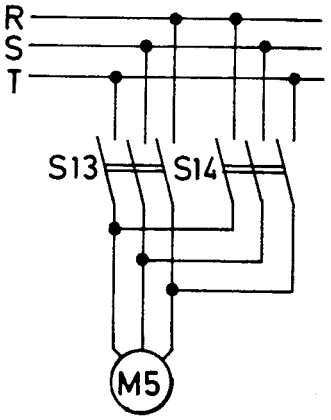

The limit switch E1 also energizes the motor M3 (by means of relays S11 and S12) which moves the longitudinal sled 80 from its one terminal position illustrated in FIG. 1 in the direction of its other terminal position which is illustrated in dash-dotted lines in FIG. 1 and in solid lines in FIG. 2. Before the longitudinal sled 80, during its leftward travel, releases the first compensating rockers 132, the leading edge of the web 56 reaches the clamping bar 60 and is immobilized thereby. For this purpose, as soon as the leading edge of the web traverses the optical barrier L2, the latter starts a timing element T4 (FIG. 10B). The time interval Z4 associated with the timing element T4 has such a length that during its run the leading end of the web 56 travels a distance from the optical barrier L2 to under the clamping bar 60. After lapse of the time interval Z4 the time element T4 de-energizes the motors M1 (via the relay S9) and M2 (via the relay S6) and energizes the motor M5 (via the relay S13) associated with the clamping bar 60, whereupon the latter firmly holds the web 56 at the time the longitudinal sled 80 releases the first compensating rockers 132. It is to be understood that the optical barrier L2 may, in the alternative, also be arranged in the zone of the clamping bar 60 or, as viewed in the direction of web travel, behind the clamping bar 60, whereby the fourth time element T4 may be dispensed with.

Lastly, as the longitudinal sled 80 arrives into its left end position (FIG. 2), it actuates the limit swirch E3 which, in response, de-energizes the sled driving motor M3 by means of the relay S11.

By the time the clamping bar 60 closes or, which is less advantageous, by virtue of the actuation of the limit switch E3, the clutch K2 is disengaged and the clutch K1 is engaged. This alternative is shown in FIG. 10B.

At this point in the operational cycle the web laying machine is ready to perform the web laying operation which may be started, for example, by releasing the clamping bar 60 and energizing the drive motor 22 as well as the motor M2 by means of a non-illustrated starting switch. As a result, the laying carriage 16 starts its motion from the right towards the left as viewed in FIGS. 1 and 2.

The foregoing description of the method according to the invention as well as the operation of the web laying machine according to the invention makes it apparent that advantageously the following types of motors are used: for the motor M1 a d.c. braking and drive motor with a d.c. brake; for the motor M2, a d.c. permanent drive motor with a tachogenerator G and regulator V1 for regulating the motor rpm (FIG. 11); and for the motors M3, M4 and M5 rotary-current braking and drive motors are preferred.

If the web 56 is to be laid pairwise, after reaching the left-hand terminal position of the laying carriage 16 as viewed in FIGS. 1 and 2, the web is fixedly held by the clamping bar 60 and is severed in a direction perpendicular to the plane of FIGS. 1 and 2 by a conventional, non-illustrated cutting device, integrated in the laying aggregate 52. During the subsequent travel of the laying carriage 16 from its left-hand terminal position towards the right-hand terminal position along the laying table 10, by actuating the switch D2 for an "automatic unthreading" (FIG. 10C) the web 56 is, after the opening of the clamping bar 60, wound back on the supply reel 54 and is thus withdrawn from the laying aggregate 52 as well as from all other parts of the laying system- This automatic, complete rewinding of the web is effected according to the invention only after the leading edge of the web 56 has traversed the optical barrier L2; up to that point the switch D2 must be held in an actuated position. Further, the switching circuitry is advantageously so designed that during rewinding, the motor M2 is de-energized as soon as the leading edge of the web 56 passes the optical barrier L1. Thereafter, the upper laying carriage portion 70 is rotated by 180° into its position shown in FIG. 3 in which the supply reel 54 and the longitudinal sled 80 are situated above the feed roll 30 and the laying aggregate 52, that is, they are again in their threading position. Subsequently, by actuating the switch D1 an automatic threading of the web into the laying system is again performed.

If the laying carriage 16 is to move backwardly within a fully or partially laid web layer, the switch D3 associated with "rewinding" is actuated. In such a case, the laying carriage 16 travels from the left to the right and the web 56 is, while the longitudinal web tension is regulated by the then operative compensating roller 130 or 140, again wound onto the supply reel 54.

It is to be understood that the supply reel 54 may be, in the alternative, driven by a shaft on which it is supported or the web 56 may be pulled manually from the supply reel 54 for initiating the threading operation.

Instead of arranging the compensating rollers 130 and 140 on the upper laying carriage portion 70, one or more compensating rollers may be placed between the upper laying carriage portion 70 and the feed roll 30.

It is further feasible to dispense with the timing element T3 if the completion of the centering of one of the longitudinal web edges is reported by the edge control, for example, by requesting information from the optical barriers L3A and L3B (one "light" and one "dark"), whereupon the motor M2 is energized and the deflecting roll 122 is caused to assume its operative position. In a similar manner, after energization of the edge control, information may be requested from the motor M6 concerning the standstill state.

In the machine control circuits illustrated in FIGS. 10A–10C, 11, 12A, 12B and 13A–13D there are shown the following additional elements in an arrangement conventional by itself:

D2 designates an on-off contact associated with the unthreading of the web;

D3 is an on-off contact associated with the rewinding of the web on the supply reel 54;

S3 designates a relay associated with the threading of the web;

S4 designates a control relay for one of the two possible directions of rotation of the drive roll 90 during threading of the web;

S7 designates a control relay for the motor M4;

S10 and S20 designate control relays for reversing the rotary direction of the motor M6;

S30 designates a control relay for unthreading the web;

S31 designates a control relay for the unthreading and rewinding of the web;

E7 and E8 designate limit switches for closing and, respectively, opening, the clamping bar 60;

V1 designates a regulator for the motor M2 for the reversal of right and left run by means of the relays S4 and S5 as well as for the rpm setting to the desired value by means of the tachogenerator G; and

V2 designates a control arrangement, including an amplifier, for the motor M1 with a control circuit S9A for the switch of the relay S9 with "start" and "stop" positions.

It will be understood that the above description of the present invention is susceptible to various modifications, changes and adaptations, and the same are intended to be comprehended within the meaning and range of equivalents of the appended claims.

what is claimed is:

1. In a web laying machine having a laying table, a motor-driven laying carriage arranged for back-and-forth travel over the laying table parallel to a web laying direction; the laying carriage including a chassis, an upper part mounted on the chassis, means for a motor-driven linear displacement of the upper part transversely to the laying direction relative to the chassis and means for a rotary displacement of the upper part about a vertical axis relative to the chassis; a support mechanism mounted on said upper part and arranged for supporting a supply reel on which the web to be laid on the laying table is stored; unwinding means mounted on said upper part for rotating the supply reel; a feed roll rotatably supported on said chassis; said feed roll having an axis extending parallel to a supply reel axis when the supply reel is in position on said support mechanism; drive means for rotating the feed roll as a function of travelling speeds of said laying carriage and a laying aggregate supported on said chassis and arranged for deflecting and cutting the web; the improvement comprising:

(a) a sled carrying said support mechanism and being arranged on said upper part; said sled having a first position and a second position spaced from the first position in a direction parallel to said laying direction; said sled being movable from either of said positions to the other position by rotating said upper part through an angle of 180° by said means for a rotary displacement of the upper part;

(b) means for linearly displacing said sled relative to said upper part from either of said positions to the other position; and (c) web guide means extending generally transversely to said laying direction and supported on said sled underneath said support mechanism for causing the web to hang from the sled at approximately the same location thereof independently from an unwinding direction of said supply reel and for causing a leading end of the web to be positioned in a web intake zone of said feed roll.

2. A web laying machine as defined in claim 1, further comprising a compensating roller swingably supported upstream of said feed roll as viewed in the direction of web advance during web laying; said compensating roller being arranged for engagement by said web between said supply reel and said feed roll; and means connecting said compensating roller with said unwinding means for varying a speed of said unwinding means as a function of positions of said compensating roller for regulating the tension of the web running from said supply reel.

3. A web laying machine as defined in claim 1, further comprising a deflecting roll swingably supported on said chassis and being arranged to assume an inoperative position and an operative position; and means for moving said deflecting roll from the inoperative position into the operative position above said feed roll when a leading end of said web hangs adjacent the feed roll, whereby said web is carried by said deflecting roll into a position in which said web is partially trained about said feed roll.

4. A web laying machine as defined in claim 1, further comprising a sensor means supported above said feed roll for responding to a predetermined position of a longitudinal edge of said web; and means operatively connecting said sensor means with said means for a motor-driven linear displacement of the upper part for effecting movement of said upper part transversely to the laying direction until said sensor means responds to said predetermined position of the longitudinal edge of the web.

5. A web laying machine as defined in claim 1, wherein said upper part has a vertical axis of rotation; said first and second positions of said sled are at least approximately symmetrical with respect to said rotary axis.

6. A web laying machine as defined in claim 1, further comprising first and second compensating rollers swingably supported upstream of said feed roll as viewed in the direction of web advance during web laying; in the first position of said sled said first compensating roller being arranged for engagement by said web between said supply reel and said feed roll and said second compensating roller being in an inoperative position; in the second position of said sled said second compensating roller being arranged for engagement by said web between said supply reel and said feed roll and said first compensating roller being in an inoperative position; and means connecting said first and second compensating rollers with said unwinding means for varying a speed of said unwinding means as a function of positions of the compensating rollers when in an operative engagement with said web for regulating the tension of the web running from said supply reel.

7. A web laying machine as defined in claim 6, further comprising first and second compensating rockers articulated to said upper part and carrying said first and second compensating rollers, respectively; spring means engaging each compensating rocker for urging a respective said compensating roller against said web; in said first position, said sled depresses said first compensating rocker for maintaining said first compensating roller in an inoperative position and in said second position attained by linear displacement, said sled depresses said second compensating rocker for maintaining said second compensating roller in an inoperative position.

8. A web laying machine as defined in claim 1, wherein said support mechanism for the supply reel comprises carrier rockers held on said sled at an inclination to the horizontal and arranged to receive thereon a shaft of said supply reel; further wherein said unwinding means comprises a drive roll supported on said sled adjacent said carrier rockers and arranged for being pressed against a circumference of said supply reel when the supply reel shaft is supported and guided on said guide rockers; and means for rotating said drive roll.

9. A web laying machine as defined in claim 8, further comprising power means for adjusting the inclination of said carrier rockers to vary the pressing force between the supply reel and the drive roll.

10. A web laying machine as defined in claim 1, further comprising a sensor means supported below said support mechanism for the supply reel and above said feed roll for responding to a presence of a leading edge of the web; and means operatively connecting said sensor means with said unwinding means for reversing said unwinding means if an expected presence of the leading edge of the web is not sensed by said sensor means.

11. A web laying machine as defined in claim 10, further comprising a timing means for placing said sensor means in a standby condition; further wherein said timing means is arranged for being tripped upon energization of said unwinding means.

12. A web laying machine as defined in claim 1, wherein said laying carriage has runner wheels for travel parallel to said web laying direction; further comprising first force transmitting means connecting at least one of said runner wheels with said feed roll for driving said feed roll by said runner wheels as a function of the travelling speed of said laying carriage; a first clutch means operatively coupled to said first force transmitting means to force-transmittingly connect said first force transmitting means to or disconnect said first force transmitting means from said feed roll; an auxiliary motor; second force transmitting means connecting said auxiliary motor to said feed roll; and second clutch means operatively coupled to said second force transmitting means to force-transmittingly connect said second force transmitting means to or disconnect said second force transmitting means from said feed roll.

13. A web laying machine as defined in claim 12, further comprising a deflecting roll swingably supported on said chassis and being arranged to assume an inoperative position and an operative position; and means for moving said deflecting roll from the inoperative position into the operative position above said feed roll when a leading end of said web hangs adjacent the feed roll, whereby said web is carried by said deflecting roll into a position in which said web is partially trained about said feed roll; further comprising a limit switch situated adjacent said deflecting roll and arranged for generating a signal upon said deflecting roll reaching said operative position; said limit switch being connected with said auxiliary motor for enerigizing said auxiliary motor with said signal.

14. A web laying machine as defined in claim 13, further wherein said means for linearly displacing said sled relative to said upper part includes a sled drive motor; said limit switch being connected with said sled drive motor for energizing said sled drive motor with said signal to displace said sled from one of its positions above said feed roll to the other of its positions remote from said feed roll.

15. A web laying machine as defined in claim 14, further comprising a sensor means situated below said feed roll for responding to a presence of a leading edge of the web; said sensor means being connected to said second clutch means and said auxiliary motor for disengaging said second clutch means and de-energizing said auxiliary motor upon a signal generated by said sensor means.

16. A web laying machine as defined in claim 15, further comprising clamping means mounted on said laying aggregate for grasping and immobilizing the web; and means connecting said sensor means with said clamping means for actuating said clamping means upon a signal by said sensor means.

17. A web laying machine as defined in claim 15, further comprising means connecting said sensor means to said first clutch means for effecting engagement of said first clutch means upon a signal generated by said sensor means.

18. A web laying machine as defined in claim 13, further comprising means connecting said sensor means with said unwinding means for de-energizing said unwinding means upon a signal generated by said sensor means.

19. In a method of laying a web in consecutive layers by a web laying apparatus on a laying table, including the steps of moving a web laying carriage back-and-forth above the laying table; withdrawing the web from a supply reel supported on a sled mounted on said carriage; training the web partially about a feed roll mounted on the carriage between the supply reel and the laying aggregate; and dispensing the web from a laying aggregate mounted on the carriage; the improvement comprising the following consecutive steps:

(a) prior to training the web about the feed roll, positioning the supply reel in a first position generally vertically above the feed roll;

(b) unwinding the supply roll until a leading end of the web hangs adjacent the feed roll;

(c) moving a deflecting roll from an inoperative position past the feed roll thereabove into an operative position, whereby the deflecting roll carries the web over the feed roll and sets the web into a position in which the web is partially trained about the feed roll; and (d) moving said supply reel linearly and horizontally relative to the laying carriage into a second position remote from said feed roll.

20. A method as defined in claim 19, further comprising the following steps:

(e) transversely cutting the web upon completion, of laying each layer;

(f) rewinding the web onto the supply reel;

(g) moving the supply reel into its first position by rotating the supply reel in a circular horizontal path about a vertical axis relative to the laying carriage and (h) subsequent to step (g), performing in sequence said steps (b), (c) and (d).

* * * * *